United States Patent [19]

Garland

[11] Patent Number: 4,470,551

[45] Date of Patent: Sep. 11, 1984

[54] MACHINE FOR COMMINUTING MATERIALS

[76] Inventor: Paul A. Garland, 4, Castle Hill, Richmond, North Yorkshire, England

[21] Appl. No.: 346,244

[22] Filed: Feb. 5, 1982

[30] Foreign Application Priority Data

Feb. 9, 1981 [GB] United Kingdom ..... 8103942

[51] Int. Cl.[3] ..... B02C 19/00

[52] U.S. Cl. ..... 241/275; 241/5

[58] Field of Search ..... 241/5, 79.1, 275, DIG. 10

[56] References Cited

U.S. PATENT DOCUMENTS 3,044,720 7/1962 Bridgewater ..... 241/275
3,881,664 5/1975 Bowling, Jr. et al. ..... 241/275
4,179,075 12/1979 Rachais ..... 241/275 X

FOREIGN PATENT DOCUMENTS 1080779 10/1964 United Kingdom .
2069357 8/1981 United Kingdom .

*Primary Examiner*—Mark Rosenbaum
*Attorney, Agent, or Firm*—McAulay, Fields, Fisher, Goldstein & Nissen

[57] ABSTRACT

A machine for comminuting material by impact has a hollow impeller rotatable about a substantially vertical axis. The impeller has an upwardly opening material inlet and at least one radially outward material outlet. A tube serves to feed material to be comminuted into the material inlet. The lower portion of the tube rotates about its longitudinal axis and imparts an angular velocity to the material fed therethrough. Material entering the impeller travels along at least a portion of the interior walls of the impeller and on emerging from the impeller strikes an anvil where comminution occurs.

8 Claims, 11 Drawing Figures

MACHINE FOR COMMINUTING MATERIALS

This invention relates to a machine for comminuting materials, and in particular to an impact breaker, which is a machine for comminuting brittle materials by the dissipation of kinetic energy by impact.

In most impact breakers the material to be comminuted is dropped into a chamber in which an arbor carrying radially disposed hammers rotates at fairly high speed. The hammers propel the material against anvils, some breakage of the material occurring during the impact between the hammers and the material, an some breakage occurring when the material strikes the anvils. It has been observed, in practice, that most breakage occurs during the impact between the hammers and the material.

Known impact breakers can be divided into two main groups, namely horizontal shaft breakers, and vertical shaft breakers. The first mentioned type is the most common, and an example of such a breaker is shown in FIG. 1 of the accompanying drawings. It will be seen that this breaker comprises a rotor 101 which carries a pair of radially disposed hammers 102. Material 103 fed into the breaker strikes these hammers which propel it against two spring-loaded anvils 104.

Horizontal shaft impact breakers have a number of disadvantages. Firstly, they are inefficient in terms of their energy consumption. Secondly, they are subject to a very high degree of wear. Thirdly, they are unable to cope economically with highly abrasive materials. For example, they are not satisfactory for material having a free silica content greater than 30%.

A known type of vertical shaft impact breaker is shown in FIG. 2 of the accompanying drawings. In this machine material 203 is fed in through a feed tube 205 whose height can be adjusted, and the material fed in strikes a rotor 201 which carries impellers 202. The impellers propel the material against surrounding anvils 204, and the broken material leaves through a downwardly directed discharge outlet 206. Like the horizontal shaft impact breakers, vertical shaft machines are inefficient in terms of energy consumption, and they are also poor at coping with very abrasive materials.

According to the present invention there is provided a machine for comminuting material by impact, comprising a hollow impeller rotatable about a substantially vertical axis and having an upwardly opening material inlet and at least one radially outward material outlet; means for feeding the material to be comminuted into the said material inlet, the said feeding means being arranged to impart to the material being fed an angular velocity about an axis substantially coincident with the axis of rotation of the impeller; and at least one anvil arranged to be struck by material which has emerged from said at least one material outlet after travelling along at least a portion of the interior walls of the impeller.

In the accompanying drawings:

FIG. 1, as mentioned above, is a diagrammatic view of a known horizontal shaft impact breaker;

FIG. 2, as mentioned above, is a diagrammatic view of a known vertical shaft impact breaker;

FIG. 11 is a plan view of the whole of the accelerator plate just referred to.

Figure 1:
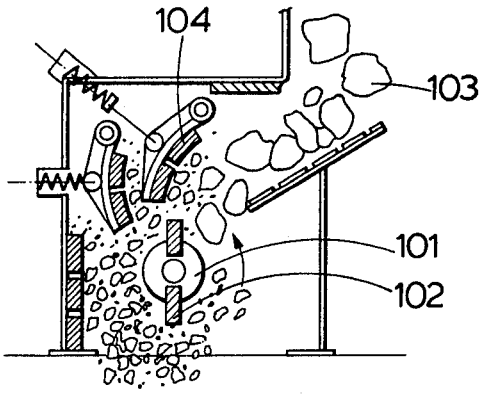
Fig.1 (PRIOR ART)
Figure 2:
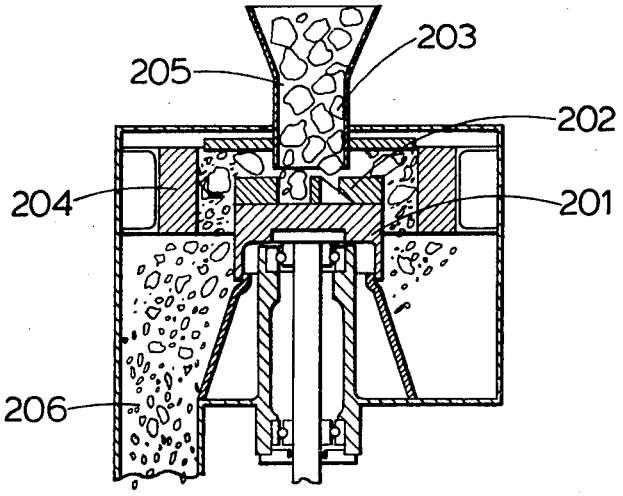
Fig.2 (PRIOR ART)
Figure 3:
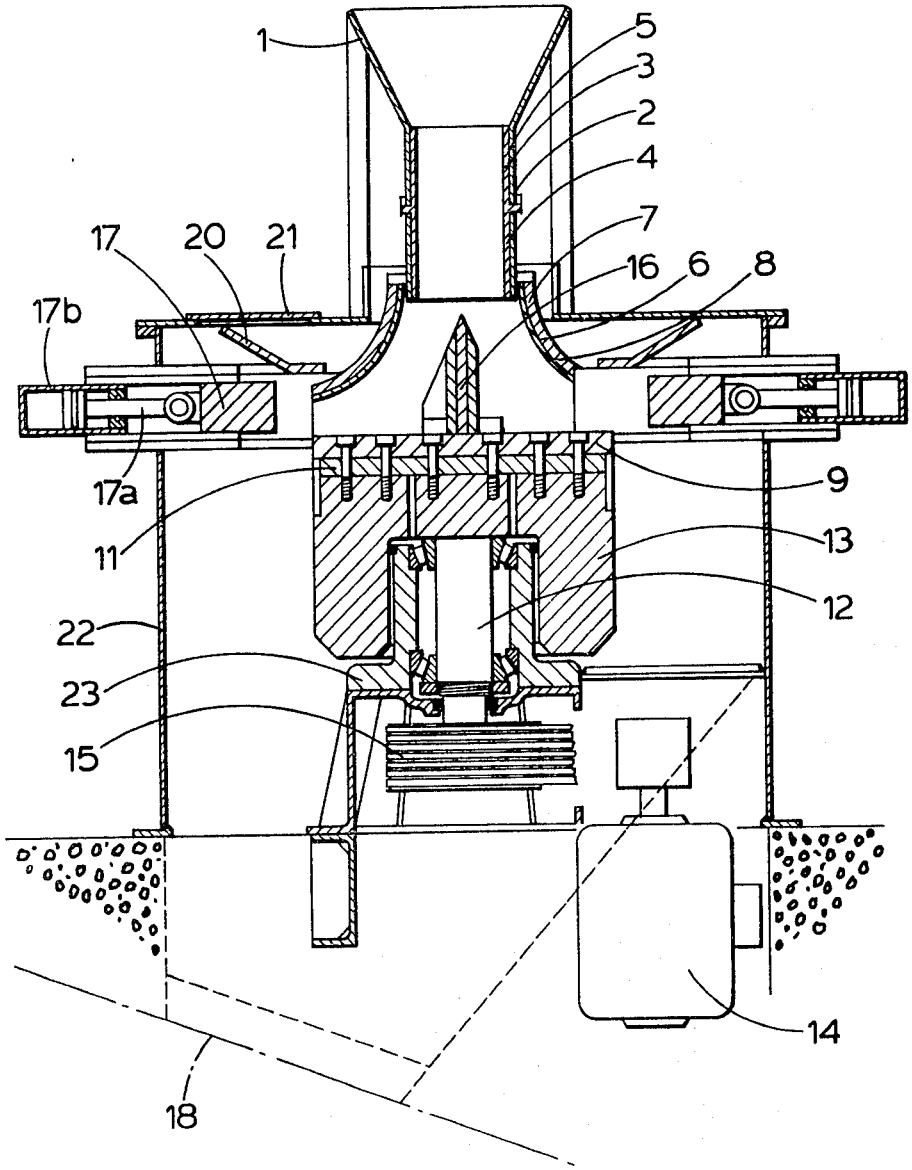
FIG. 3 is a diagrammatic vertical section through one embodiment of a machine according to the present invention.
Figure 4:
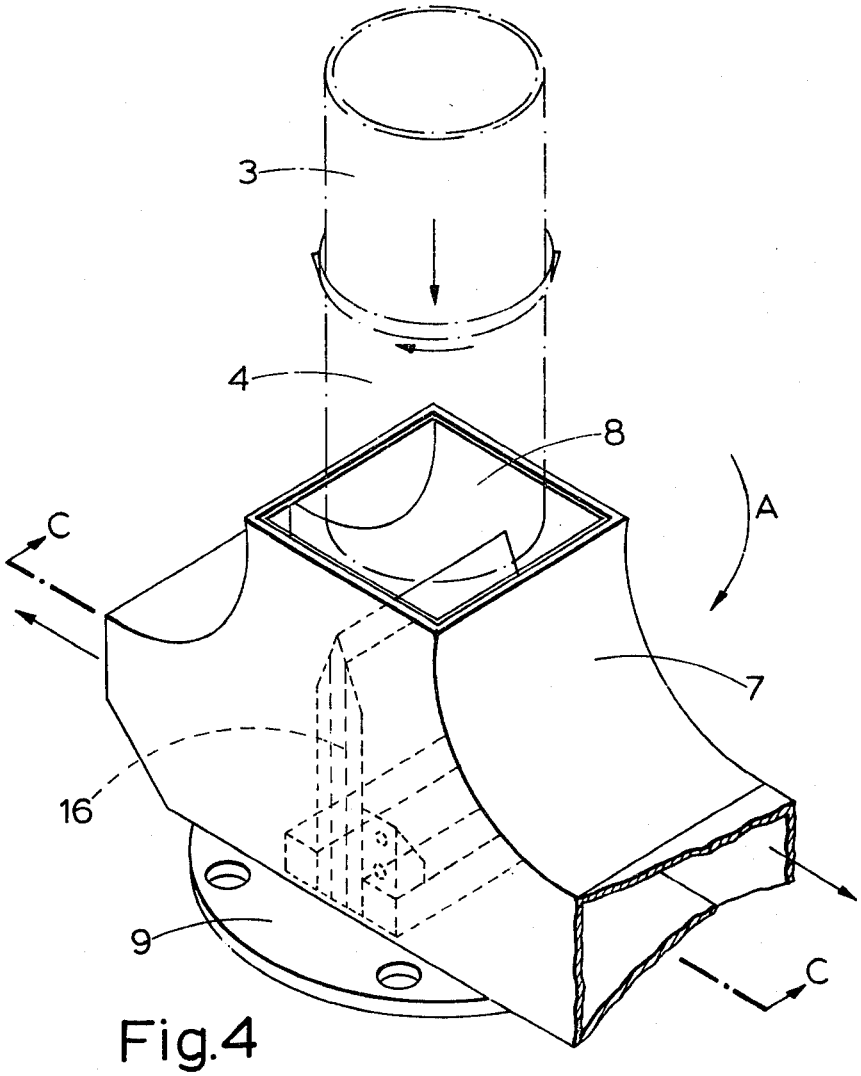
FIG. 4 shows in more detail and on a larger scale a perspective view of an impeller forming part of the machine of FIG. 3.
Figure 5:
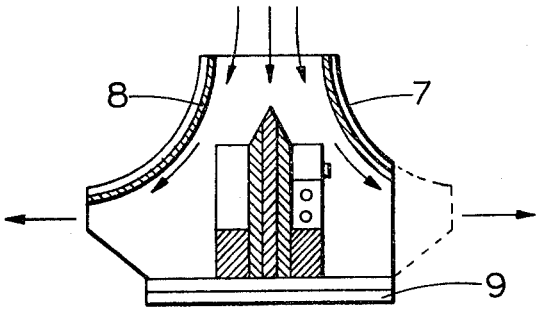
FIG. 5 is a section on line C—C in FIG. 4.
Figure 6:
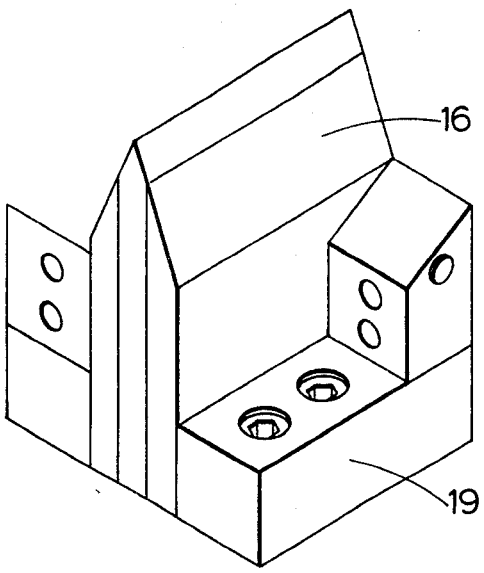
FIG. 6 is a perspective view showing an accelerator plate which forms part of the impeller shown in FIG. 4.

The impact breaker shown in FIGS. 3 to 6 comprises a hopper 1 for the entry of material to be comminuted, the hopper leading to a feed tube 2. The feed tube 2 has an upper stationary portion 3 and a lower rotating portion 4. This can be seen most clearly in FIG. 4. The inside of the feed tube 2 is provided with an abrasion-resistant lining 5. Material leaving the lower end of the feed tube 2 enters a hollow impeller 6. It will be appreciated that by the time the material enters the impeller it has already acquired some angular momentum as a result of the rotation of the lower feed tube portion 4. The impeller 6 includes upper curved walls 7 and side walls, all of which are provided with an abrasion-resistant lining 8. The impeller further comprises a circular plate 9 which is secured by screws 10, via a further plate 11, to the upper end of a drive shaft 12. The plates 9 and 11 are also connected by the screws 10 to a flywheel 13. Drive is imparted to the drive shaft 12 from the drive motor 14 via a belt 15.

An accelerator plate 16 is mounted diametrically on the plate 9, the plate 16 being mounted by means of a pair of stop blocks 19. In the illustrated embodiment the plate 16 is mounted at right angles to the side walls but other angles of mounting could be used instead. In the embodiment illustrated in FIG. 6, the plate 16 is formed of a central plate sandwiched between two outer plates. The central plate is made of a very hard, high carbon alloy whereas the outer plates are made of a less hard medium carbon alloy. Other materials could, however, be used instead. The upper portion of the plate 16 is wedge-shaped, and as material emerges from the lower end of the feed tube 2 it is divided by the plate 16 so that some of the material passes to one side of the plate and some of the material passes to the other side. Rotation of the impeller, which takes place in the direction indicated by arow A in FIG. 4, throws material radially outwardly so that it travels along the side walls and upper walls of the impeller before it strikes an array of hydraulically mounted anvils 17 disposed, as in known impact breakers, on the lines of involute curves generated from the impeller circle. The anvils are mounted on pistons 17*a* slidable in hydraulic cylinders 17*b*. The array of anvils is arranged to be radially and axially adjustable as an array. In addition, diametrically opposed anvils can be connected hydraulically to one another in parallel to resolve evenly the crushing forces and provide overload relief against incrushables, the latter being achieved by providing for the anvils to be moded hydralically away from one another if a force acts thereon which exceeds a predetermined maximum.

Material striking the anvils 17 is broken up by the impact and falls onto a conveyor 18 whose position is indicated for simplicity by a line. The conveyor then carries the comminuted material away.

Also shown in the drawings is a deflector ring 20, which catches small particles and helps to create an outward radial airflow which assists the removal of dust and fines, an access door 21, a casing 22 and a bearing housing 23. In addition, means, not shown, are provided which permit balancing of the impeller.

One particularly notworthy feature of the machine described above is that it separates the effect of impact and abrasion in the machine. Abrasion takes place primarily at the location where the abrasion-resistant linings are provided, and impact takes place primarily at the anvils. This means that appropriate abrasion-resistant and impact-resistant materials can be used at each location without the need, as there is in the prior art, to compromise by using materials which have reasonable resistance both to abrasion and impact but good resistance to neither.

It is also to be noted that the machine described above is similar in operation to a centrifugal pump, and accordingly operates to transfer air in large quantities. This air will carry with it fines which can accordingly be separated from the comminuted material better than in known machines.

Figure 7:
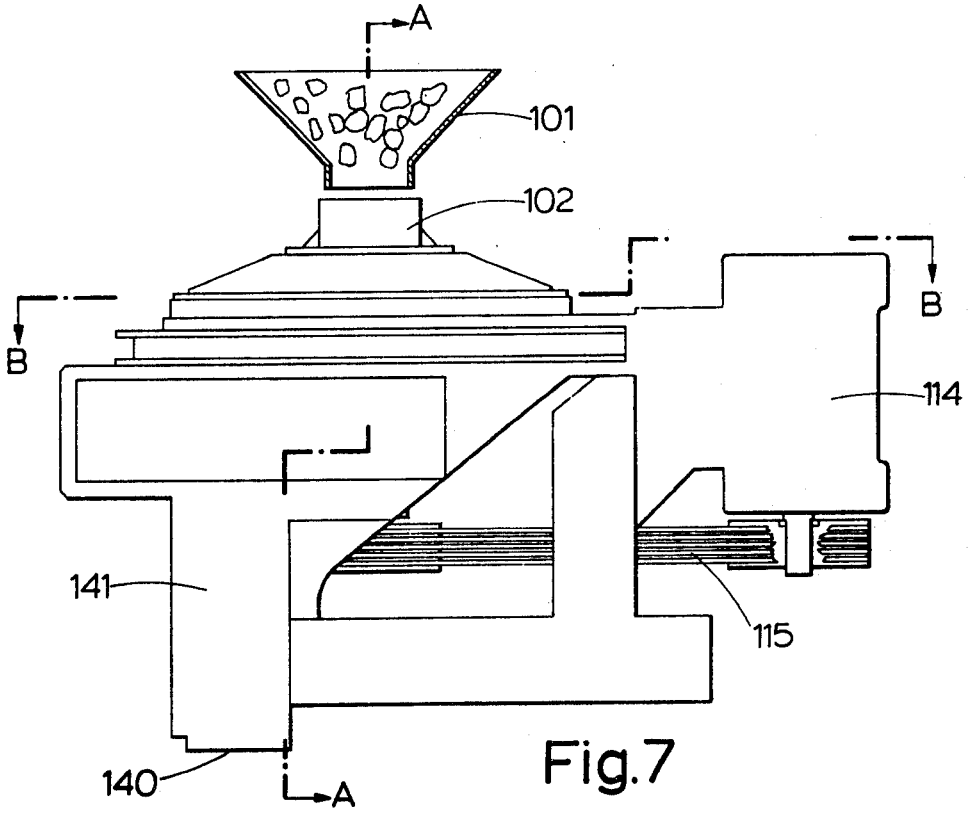
FIG. 7 is an elevation of another embodiment of machine according to the present invention.
Figure 8:
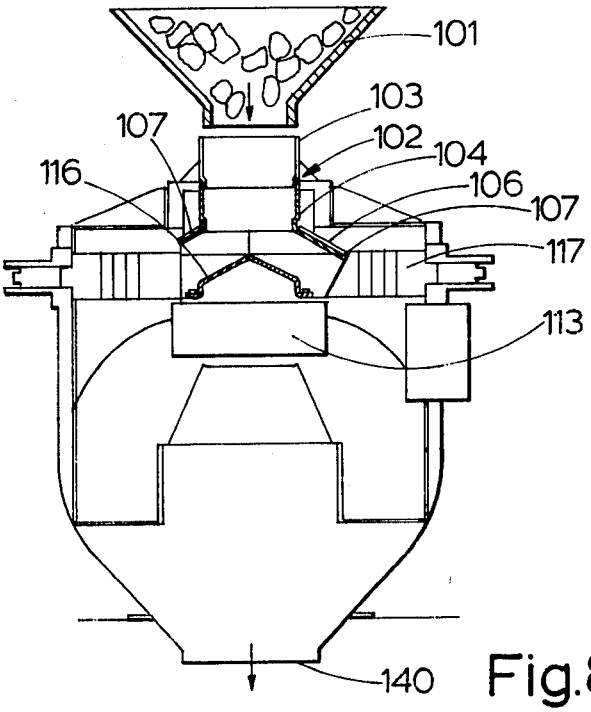
FIG. 8 is a vertical section taken on line A—A in FIG. 7.
Figure 9:
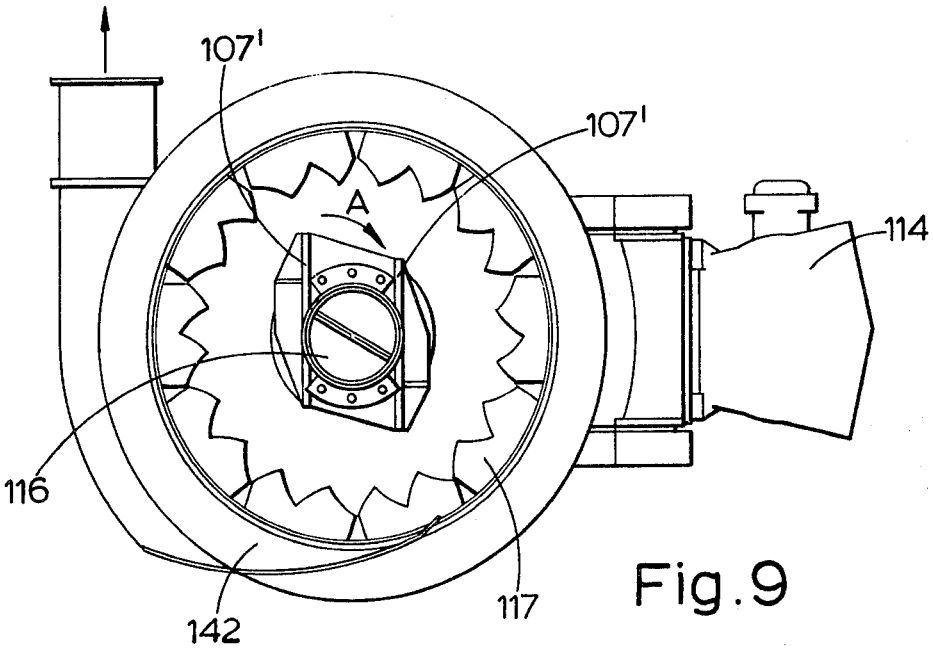
FIG. 9 is a part section, part plan, taken on line B—B in FIG. 7.
Figure 10:
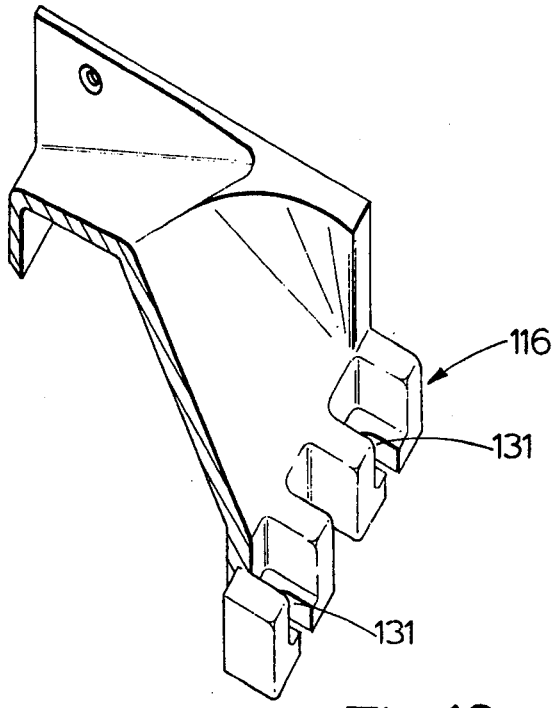
FIG. 10 is a cut away isometric view showing half of an accelerator plate shown in FIGS. 8 and 9.
Figure 11:
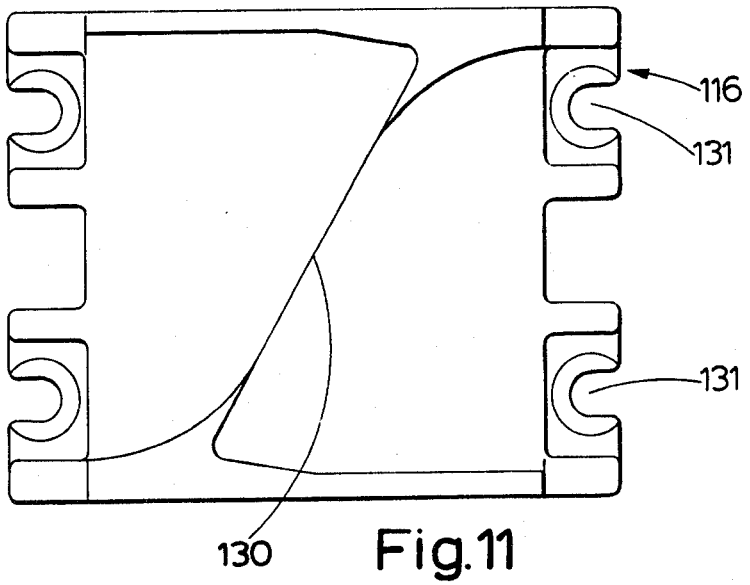

In the embodiment of FIGS. 7 to 11, as in the embodiment of FIGS. 3 to 6, material to be comminuted is introduced from a hopper 101 through a feed tube, here given reference 102, which has an upper stationary portion 103 and a lower rotating portion 104. The inside of the feed tube 102 is provided with an abrasion-resistant lining. Material leaving the lower end of the feed tube 102 enters a hollow impeller 106. This has upper downwardly sloping walls 107 and side walls 107', all of which are provided with an abrasion-resistant lining. The impeller 106 has a base which is secured to a flywheel 113. Drive is imparted to the flywheel and impeller from a drive motor 114 via a belt 115 which passes round a pair of drive pulleys.

An accelerator plate 116 is mounted on the impeller base. The accelerator plate is shown in more detail in FIGS. 10 and 11. From these Figures it can be seen to comprise a single casting, for example of high chromium cast iron or cast steel, which defines a ridge 130 which extends at an angle $\alpha$ with respect to a line perpendicular to the side walls of the plate 116.

The plate 116 is secured to the base of the impeller by bolts (not shown) which pass through apertures 131 therein.

As material emerges from the lower end of the feed tube 102 it is divided by the plate 116 so that some of it passes to one side of the plate and some to the other side. Rotation of the impeller, which takes place in the direction indicated by arrow A in FIG. 9, throws material radially outwardly so that it travels along the side walls and upper walls of the impeller before it strikes an array of anvils 117. Material striking the anvils 117 is broken up by the impact and leaves through an outlet 140 located at the bottom of a discharge chute 141. A volute 142 is provided in the machine casing to collect rotating dust and fines and carry them in the airflow to a cyclone or baghouse for separation.

The efficiency of the machine may be increased by choosing the length and diameter of the stationary feed tube such that a condition of choked feed exists.

Choked feed dropping vertically down the rotating feed tube will have at its periphery some component of tangential velocity and therefore centripetal force. This force is a direct result of the friction between the feed and the side walls of the feed tube. This will cause the feed to have less vertical velocity, i.e. it will reduce the acceleration due to gravity. This will not necessarily apply to the central core of feed at the top of the rotating feed tube. However, if the rotating feed tube is of the correct length even the central particles of feed will become radially unstable and on reaching the radial passages in the impeller will travel mainly in a horizontal direction guided by the side walls of the impeller.

Due to the difference in rotational speed between the impeller and the feed, those particles not radially restrained due to the angular position of the side walls will be gathered by the side walls at a greater radius as they attempt to travel radially outwards. They will then be constrained to travel outwards along the upper sides and internal top of the impeller. Feed dropping in a position where its radial path is restrained by the side walls will be subject to a centripetal force anchoring it to the side wall and will remain there until the following build up renders it unstable. It will then travel along side walls as previously described. This latter effect will generally reduce the impact of the feed and assist in the reduction of wear.

I claim:

1. A machine for comminuting material by impact, comprising a hollow impeller rotatable about a substantially vertical axis and having interior walls, an upwardly opening material inlet and at least one radially outward material outlet; means for feeding the material to be comminuted into the said material inlet, said feeding means comprising a feed member spaced from and in alignment with said material inlet, said feed member having an upper stationary portion and a lower portion connected thereto which is rotatable to impart to the material being fed an angular velocity about an axis substantially coincident with the axis of rotation of the impeller; said feed member being sized as to create a choked feed of material passing therethrough whereby the angular velocity is imparted to material entering said inlet; and at least one anvil arranged to be struck by material which has emerged from the said at least one material outlet after travelling along at least a portion of the interior walls of the impeller.

2. A machine according to claim 1, wherein the impeller is provided with means in a central region thereof for deflecting radially outwardly any material falling on to the said deflecting means from the material inlet.

3. A machine according to claim 1 or 2, comprising means for removing from the airflow generated by the impeller fines produced by comminution.

4. A machine according to claim 1, wherein the impeller comprises a pair of top walls which slope downwardly away from the material inlet, a base, and a pair of side walls connecting the top walls to the base.

5. A machine according to claim 1, wherein the interior surfaces of the walls of the impeller are lined with an abrasion-resistant lining.

6. A machine according to claim 1, wherein the said feeding means comprises a downwardly extending tube.

7. A machine according to claim 6, wherein the said tube is lined with an abrasion-resistant lining.

8. A machine according to claim 1, comprising at least a pair of anvils, and hydraulic connecting means connecting each one of said pair of anvils for movement away from each other if a force acts thereon which exceeds a predetermined maximum force.

* * * * *